US011330911B2

(12) United States Patent
Wang et al.

(10) Patent No.: US 11,330,911 B2
(45) Date of Patent: May 17, 2022

(54) ADJUSTABLE BED

(71) Applicant: Nisco Co., Ltd, Jiangsu (CN)

(72) Inventors: Wei Wang, Jiangsu (CN); Jian Xie, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 76 days.

(21) Appl. No.: 16/867,674

(22) Filed: May 6, 2020

(65) Prior Publication Data

US 2021/0177153 A1 Jun. 17, 2021

Related U.S. Application Data

(60) Provisional application No. 62/962,324, filed on Jan. 17, 2020, provisional application No. 62/947,561, filed on Dec. 13, 2019.

(51) Int. Cl.
*A47C 20/04* (2006.01)

(52) U.S. Cl.
CPC ..... *A47C 20/041* (2013.01)

(58) Field of Classification Search
CPC ..... A47C 20/041; A61G 7/018
See application file for complete search history.

(56) References Cited

U.S. PATENT DOCUMENTS

2006/0130236 A1 6/2006 Dewert et al.
2009/0094748 A1* 4/2009 Long ..... A47C 20/08 5/613

FOREIGN PATENT DOCUMENTS

DE 4200102 A1 * 7/1993 ..... A47C 20/041
DE 19908084 C1 5/2000
DE 202008001634 U1 * 7/2009 ..... A47C 20/041
DE 102008050255 A1 4/2010
DE 102015122605 A1 6/2017

OTHER PUBLICATIONS

European Patent Office, "European Extended Search Report for EP Appln No. 20173903 4", The Hague, dated Jun. 29, 2020.

* cited by examiner

*Primary Examiner* — David R Hare
*Assistant Examiner* — Adam C Ortiz
(74) *Attorney, Agent, or Firm* — Locke Lord LLP; Tim Tingkang Xia, Esq.

(57) ABSTRACT

An adjustable bed system includes a pair of side rails transversely spaced, longitudinally aligned and arranged parallel to each other; and a pair of lifting assemblies attached respectively to the pair of side rails for operably adjusting positions of at least one part of a bed. Each lifting assembly comprises a back lifting arm and a leg lifting mechanism; a bracket; and a back lifting actuator and a leg lifting actuator received in the bracket. Each actuator includes an activation member and a motor member engaged with the activation member for driving the activation member. The activation member of the back lifting actuator is engaged with the back lifting arm for operably adjusting the back lifting arm at desired back positions. The activation member of the leg lifting actuator is engaged to the leg lifting mechanism for operably adjusting the leg lifting mechanism at desired leg positions.

13 Claims, 15 Drawing Sheets

ADJUSTABLE BED

CROSS-REFERENCE TO RELATED PATENT APPLICATIONS

This application claims priority to and the benefit of U.S. Provisional Patent Application Ser. Nos. 62/947,561 filed Dec. 13, 2019 and 62/962,324 filed Jan. 17, 2020, which are incorporated herein in their entireties by reference.

FIELD OF THE INVENTION

The invention generally relates to a bed, and more particular to adjustable bed systems with power-driven lifting assemblies.

BACKGROUND OF THE INVENTION

Sleep is critical for people in every aspect of their lives. Beds are necessary furniture for people to sleep on. A conventional bed usually has a fixed size, such as a king size, a queen size or a full size, which cannot be changed, without body positions adjustable, and also requires professionals to install. Thus, it is beneficial and desirable for people to have a bed system that is capable of adjusting body positions based on user's sleep preference so that the user achieves maximum comfort during sleep. In addition, it is also beneficial and desirable that the bed system can be easily assembled to improve assembly efficiency and increase the user's assembly experience. It is further beneficial and desirable that the size of the bed system can be changeable from one size to another size.

SUMMARY OF THE INVENTION

In one aspect, the invention relates to an adjustable bed system with power-driven lifting assemblies.

In one embodiment, the adjustable bed system includes a pair of side rails transversely spaced, longitudinally aligned and arranged parallel to each other; and a pair of lifting assemblies attached respectively to the pair of side rails for operably adjusting positions of at least one part of a bed. Each lifting assembly comprises a back lifting arm and a leg lifting mechanism; a bracket; and a back lifting actuator and a leg lifting actuator received in the bracket. Each of the back and leg lifting actuators comprises an activation member and a motor member engaged with the activation member for driving the activation member. The activation member of the back lifting actuator is engaged with the back lifting arm for operably adjusting the back lifting arm at desired back positions. The activation member of the leg lifting actuator is engaged to the leg lifting mechanism for operably adjusting the leg lifting mechanism at desired leg positions.

In one embodiment, the adjustable bed system further includes an upper rail and a lower rail being longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, where each of the upper rail and the lower rail has a length L that is adjustable or fixed and defines a size of the bed.

In one embodiment, the activation member comprises a driving shaft having a first portion and a second portion extending from the first portion, the second portion being engaged with the motor member. The activation member of the back lifting actuator is engaged with the back lifting arm through engaging the first portion of the driving shaft with one end portion of the back lifting arm. The activation member of the leg lifting actuator is engaged with the leg lifting mechanism through engaging the first portion of the driving shaft with one end portion of the leg lifting mechanism.

In one embodiment, the driving shaft further has at least one claw protruded from the second portion such that the second portion is engaged with the motor member through the at least one claw.

In one embodiment, the activation member further comprises a shoulder mounted on the first portion of the driving shaft for engaging the first portion of the driving shaft with said one end portion of the back lifting arm or the leg lifting mechanism.

In one embodiment, the motor member comprises a body having an opening formed at one end portion and a motor mounted on the body. The opening is configured for receiving the second portion of the driving shaft of the activation member so as to engage the motor member with the activation member.

In one embodiment, the bracket comprises a base member attached to a respective one of the pair of side rails, a pair of tab members vertically attached to the base member, and a pair of bars transversely attached to top portions of the pair of tab members.

In one embodiment, one of the pair of tab members is attached to the base member and the other of the pair of tab members is attached to the respective side rail such that the pair of tab members is transversely spaced, longitudinally aligned and parallel to each other. The pair of bars is longitudinally spaced and transversely aligned and parallel to each other. Each tab member has two connecting holes defined at two end portions of said tab member, and the pair of bars is positioned between the connecting holes of the pair of tab members.

In one embodiment, each tab member comprises a single tab or a plurality of tabs.

In one embodiment, as assembled, the driving shaft of the activation member is rotatably connected to the pair of tab member through respective connecting holes and a groove formed in another end portion of the body of the motor member receives a respective one of the pair of bars, so that the back lifting actuator and the leg lifting actuator securely attached to the bracket.

In one embodiment, the leg lifting mechanism comprises first, second, third and fourth supporting members, where a first end of the first supporting member is connected to the first portion of the driving shaft of the leg lifting actuator, first ends of the second and third supporting members are connected to a second end of the first supporting member, a first end of the fourth supporting member is connected to a second end of the third supporting member.

In one embodiment, the leg lifting mechanism further comprises an elastic member connected between the second end of the second supporting member and a position of the third supporting member.

In one embodiment, the adjustable bed system further includes a plurality of platforms disposed on the pair of lifting assemblies and coupled with the back lifting arm and the leg lifting mechanism such that positions of at least one or more of the plurality of platforms are adjustable in accordance with operations of the back lifting arm and the leg lifting mechanism.

In one embodiment, the plurality of platforms comprises a seat platform mounted on tops of the brackets of the lifting assemblies; at least one back platform coupled with the back lifting arm, such that the at least one back platform is operably rotatable around its lower edge in a back platform downward rotating direction or a back platform upward rotating direction; and a thigh platform and a leg platform coupled to the leg lifting mechanism, such that the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

In one embodiment, the adjustable bed system further includes a controller configured to control operations of the back lifting actuator and the leg lifting actuator of each lifting assembly, so as to lift individually or cooperatively the back lifting arm and the leg lifting mechanism in desired positions, thereby adjusting the back platform, the thigh platform, and the leg platform in the desired positions.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
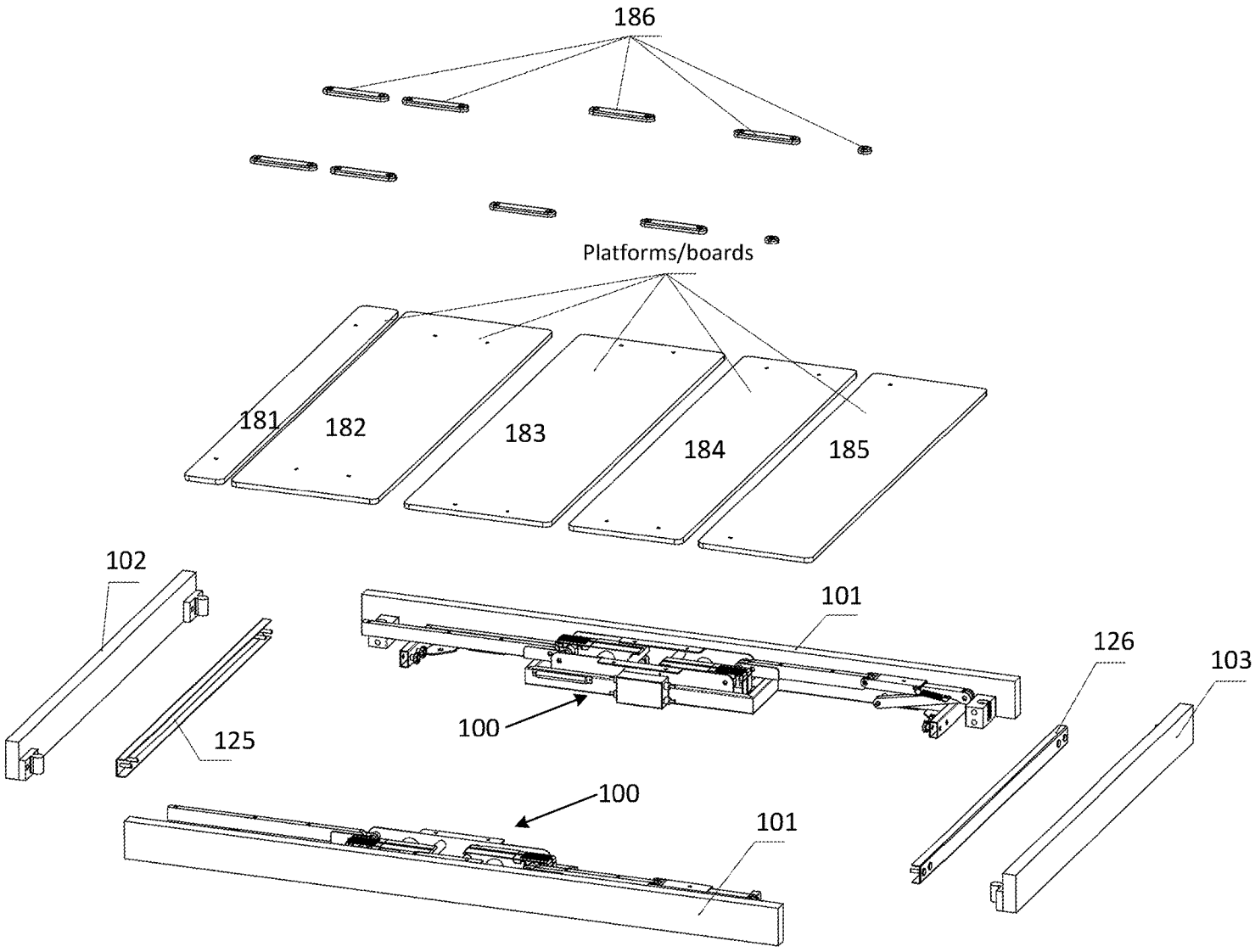
FIG. 1 shows schematically an exploded view of an adjustable bed system according to a first embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-15. In accordance with the purposes of this invention, as embodied and broadly described herein, this invention, in one aspect, relates to an adjustable bed system with power-driven lifting assemblies.

FIGS. 1-11 show an adjustable bed system according to a first embodiment of the invention.

Figure 2:
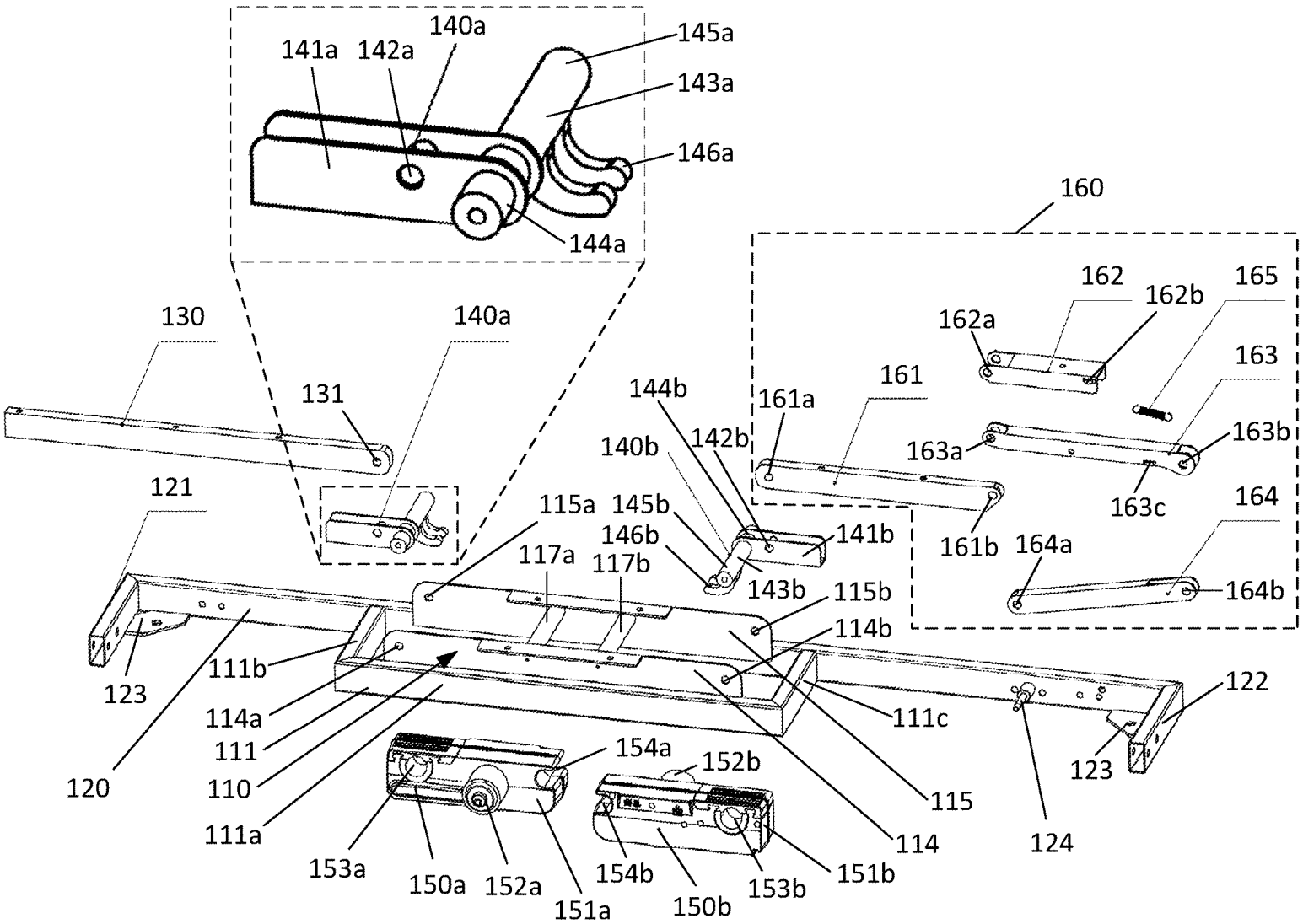
FIG. 2 shows schematically an exploded view of a lifting assembly used for the adjustable bed system shown in FIG. 1.

In this exemplary embodiment, the adjustable bed system includes a pair of side rails 120 transversely spaced, longitudinally aligned and arranged parallel to each other. The adjustable bed system also includes an upper rail 125 and a lower rail 126 being longitudinally spaced and transversely aligned. Two ends of the upper rail 125 are detachably connected to the first end portions 121 of the pair of side rails 120 and two ends of lower rail 126 are detachably connected to the second end portions 122 of the pair of side rails 120 such that the upper rail 125 and the lower rail 126 are parallel to each other, and the upper rail 125 and the lower rail 126 and the pair of side rails 120 are co-planar in a rectangle form, as shown in FIG. 2 for example. These connections can be screw-type connections or any other connection means. In the embodiment, each of the first and second end portions 121 and 122 has a reinforcing flange 123. In other embodiments, the reinforcing flange 123 can be replaced a reinforcing bar or other reinforcing means, e.g., reinforcing bars.

In addition, each of the upper rail 125 and the lower rail 126 has a length L that is adjustable or fixed and defines a size of the bed. For example, if a user wants to convert the bed system from one size to another size, e.g., from a queen size to a king size, the user only needs to adjust the length L of the upper rail 125 and the lower rail 126 to fit the king size, or replace the queen size upper rail 125 and lower rail 126 with the king size upper rail 125 and lower rail 126.

The adjustable bed system may also include anti-skid pads 128 (FIG. 6) and ribs fixing plates 129 (FIG. 9) attached to the side rails 120, which can be placed on the floor or in the bed frame and used directly. In addition, the adjustable bed system may include two side panels 101, an upper panel 102 and a lower panel 103 respectively attached to the pair of side rails 120, the upper rail 125 and the lower rail 126, as shown FIGS. 1, 5, 10 and 11.

The adjustable bed system further includes a pair of lifting assemblies 100 attached respectively to the pair of side rails 120 for operably adjusting positions of at least one part of a bed. Each lifting assembly 100 comprises a back lifting arm 130 and a leg lifting mechanism 160, a bracket 110, and a back lifting actuator and a leg lifting actuator that are received in the bracket 110.

In the exemplary embodiment, the back and leg lifting actuators are identical to each other. It should be appreciated that the back and leg lifting actuators can be different from each other in certain embodiments.

The back lifting actuator comprises an activation member 140*a* and a motor member 150*a* engaged with the activation member 140*a* for driving the activation member 140*a*. The activation member 140*a* of the back lifting actuator is engaged with the back lifting arm 130 for operably adjusting the back lifting arm 130 at desired back positions.

As shown in FIG. 2, the activation member 140*a* comprises a driving shaft 143*a* having a first portion 144*a* and a second portion 145*a* extending from the first portion 144*a*. The second portion 145*a* is used to engage with the motor member 150*a*. In one embodiment, the driving shaft 143*a* may further have two claws 146*a* protruded from the second portion 145*a* such that the second portion 145*a* is engaged with the motor member 150*a* through the claws 146*a*.

The activation member 140*a* is engaged with the back lifting arm 130 through engaging the first portion 144*a* of the driving shaft 143*a* with one end portion of the back lifting arm 130, such that the rotation of the driving shaft 143*a* causes position adjusting of the back lifting arm 130. In addition, the activation member 140*a* further comprises a shoulder 141*a* mounted on the first portion 144*a* of the driving shaft 143*a* for engaging the first portion 144*a* of the driving shaft 143*a* with said one end portion of the back lifting arm 130, and the shoulder 141*a* is pivotally connected to said one end portion of the back lifting arm 130 by a pin, or any other connection means at a pivotal point 142*a*.

The motor member 150*a* comprises a body 151*a* having an opening 153*a* formed at one end portion, a groove 154*a* formed at another end portion, and a motor 152*a* mounted on the body 151*a*. The opening 153*a* is configured for receiving the second portion 145*a* of the driving shaft 143*a* of the activation member 140*a* so as to engage the motor member 150*a* with the activation member 140*a*.

Similarly, the leg lifting actuator comprises an activation member 140*b* and a motor member 150*b* engaged with the activation member 140*b* for driving the activation member 140*b*. The activation member 140*b* of the leg lifting actuator is engaged with the leg lifting mechanism 160 for operably adjusting the leg lifting mechanism 160 at desired leg positions.

The activation member 140*b* comprises a driving shaft 143*b* having a first portion 144*b* and a second portion 145*b* extending from the first portion 144*b*. The second portion 145*b* is used to engage with the motor member 150*b*. In one embodiment, the driving shaft 143*b* may further have two claws 146*b* protruded from the second portion 145*a* such that the second portion 145*b* is engaged with the motor member 150*b* through the claws 146*b*.

The activation member 140*b* is engaged with the leg lifting mechanism 160 through engaging the first portion 144*b* of the driving shaft 143*b* with one end portion of the leg lifting mechanism 160, such that the rotation of the driving shaft 143*a* causes position adjusting of the leg lifting mechanism 160. In addition, the activation member 140*b* further comprises a shoulder 141*b* mounted on the first portion 144*b* of the driving shaft 143*b* for engaging the first portion 144*b* of the driving shaft 143*b* with said one end portion of the leg lifting mechanism 160, and the shoulder 141*b* is pivotally connected to said one end portion of the leg lifting mechanism 160 by a pin, or any other connection means at a pivotal point 142*b*.

The motor member 150*b* comprises a body 151*b* having an opening 153*b* formed at one end portion, a groove 154*b* formed at another end portion, and a motor 152*b* mounted on the body 151*b*. The opening 153*b* is configured for receiving the second portion 145*b* of the driving shaft 143*b* of the activation member 140*b* so as to engage the motor member 150*b* with the activation member 140*b*.

Also referring to FIG. 2, the bracket 110 comprises a base member 111 attached to a respective one of the pair of side rails 120, a pair of tab members 114 and 115 vertically attached to the base member 111, and a pair of bars 117*a* and 117*b* transversely attached to top portions of the pair of tab members 114 and 115. In this exemplary embodiment, the base member 111 includes a first base rail 111*a* arranged parallel to the side rail 120, a second base rail 111*b* and a third base rail 111*c* rigidly connected to the first base rail 111*a* and the side rail 120.

In the exemplary embodiment shown in FIG. 2, the tab member 114 is attached to the first base rail 111*a* and the tab member 115 is attached to the side rail 120 such that the pair of tab members 114 and 115 is transversely spaced, longitudinally aligned and parallel to each other. In other embodiments, the base member 111 may have a fourth base rail that is arranged parallel to the first base rails 111*a* and is attached to the side rail 120. In the case, the tab member 114 is attached to the first base rail 111*a*, while the tab member 115 is attached to the fourth base rail.

In one embodiment, each tab member 114/115 has two connecting holes 114*a*/115*a* and 114*b*/115*b* defined at two end portions of said tab member 114/115. The pair of bars 117*a* and 117*b* is longitudinally spaced, transversely aligned and positioned parallel to each other between the connecting holes 114*a*/115*a* and 114*b*/115*b* of the pair of tab members 114 and 115.

Figure 12:
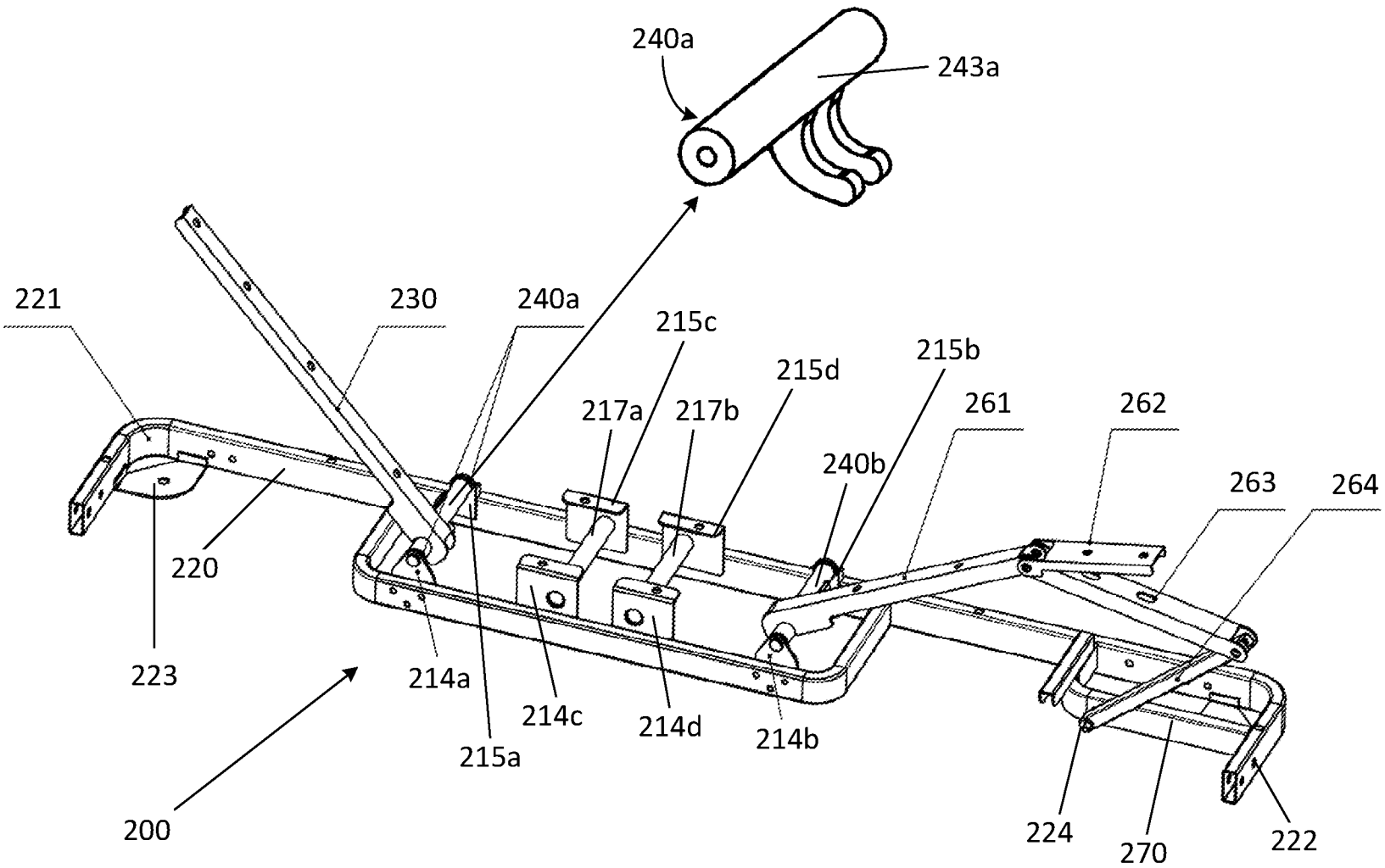
FIG. 12 shows schematically an exploded view of a lifting assembly used for an adjustable bed system according to a second embodiment of the invention.
Figure 13:
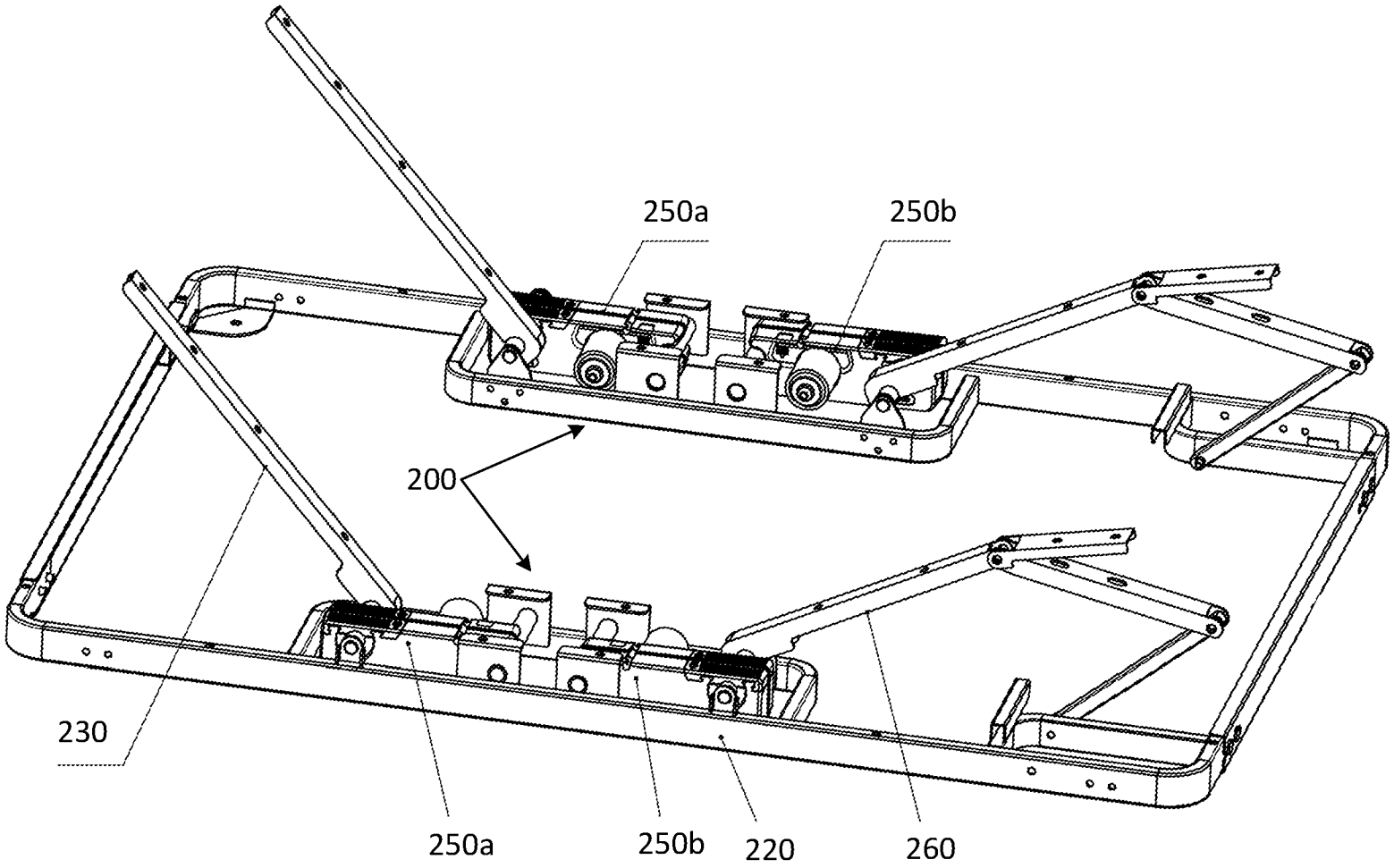
FIG. 13 shows schematically a front perspective view of the adjustable bed system in an adjusted state according to a second embodiment of the invention.
Figure 14:
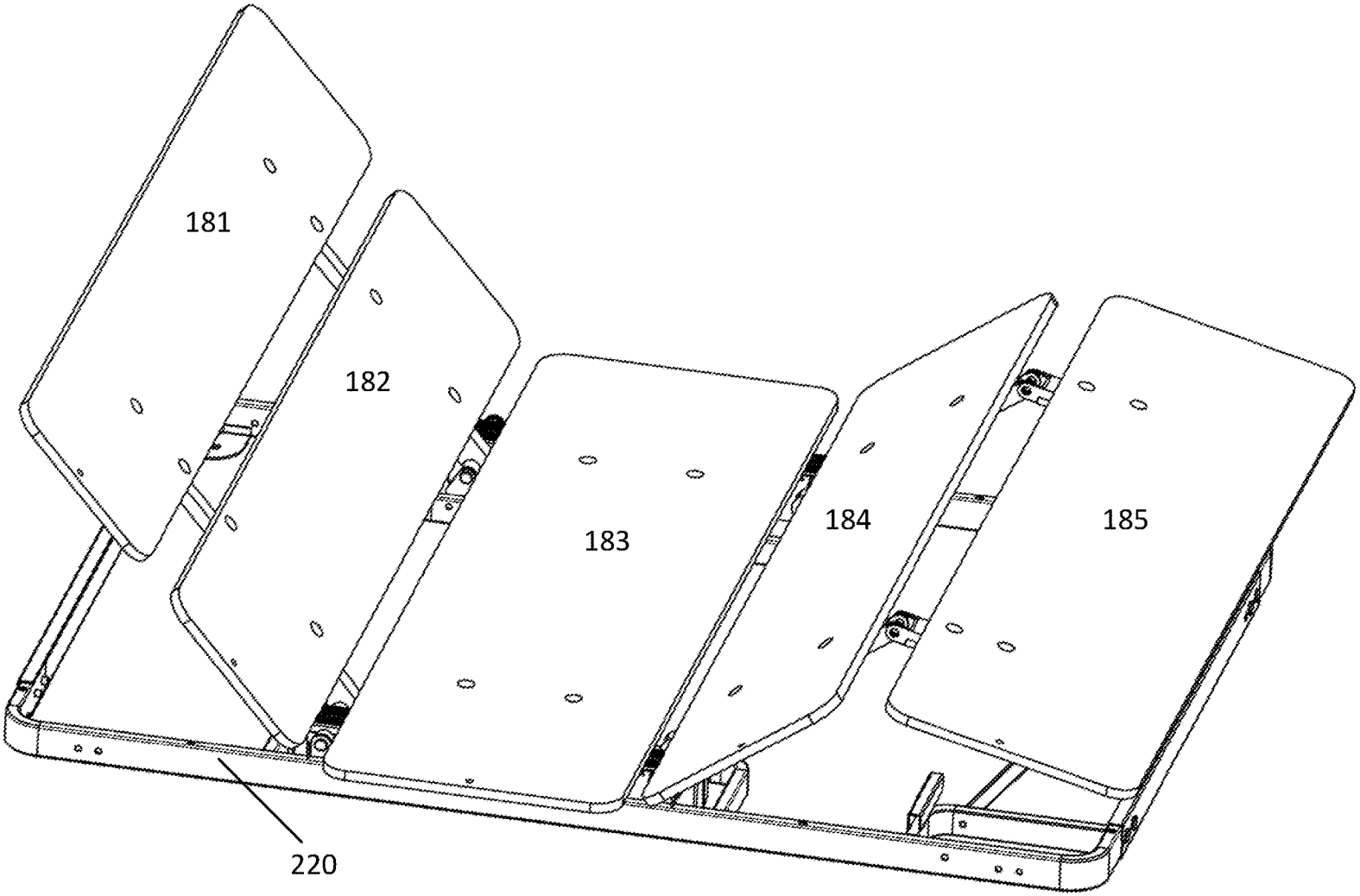
FIG. 14 shows schematically a front perspective view of the adjustable bed system in an adjusted state according to a second embodiment of the invention.
Figure 15:
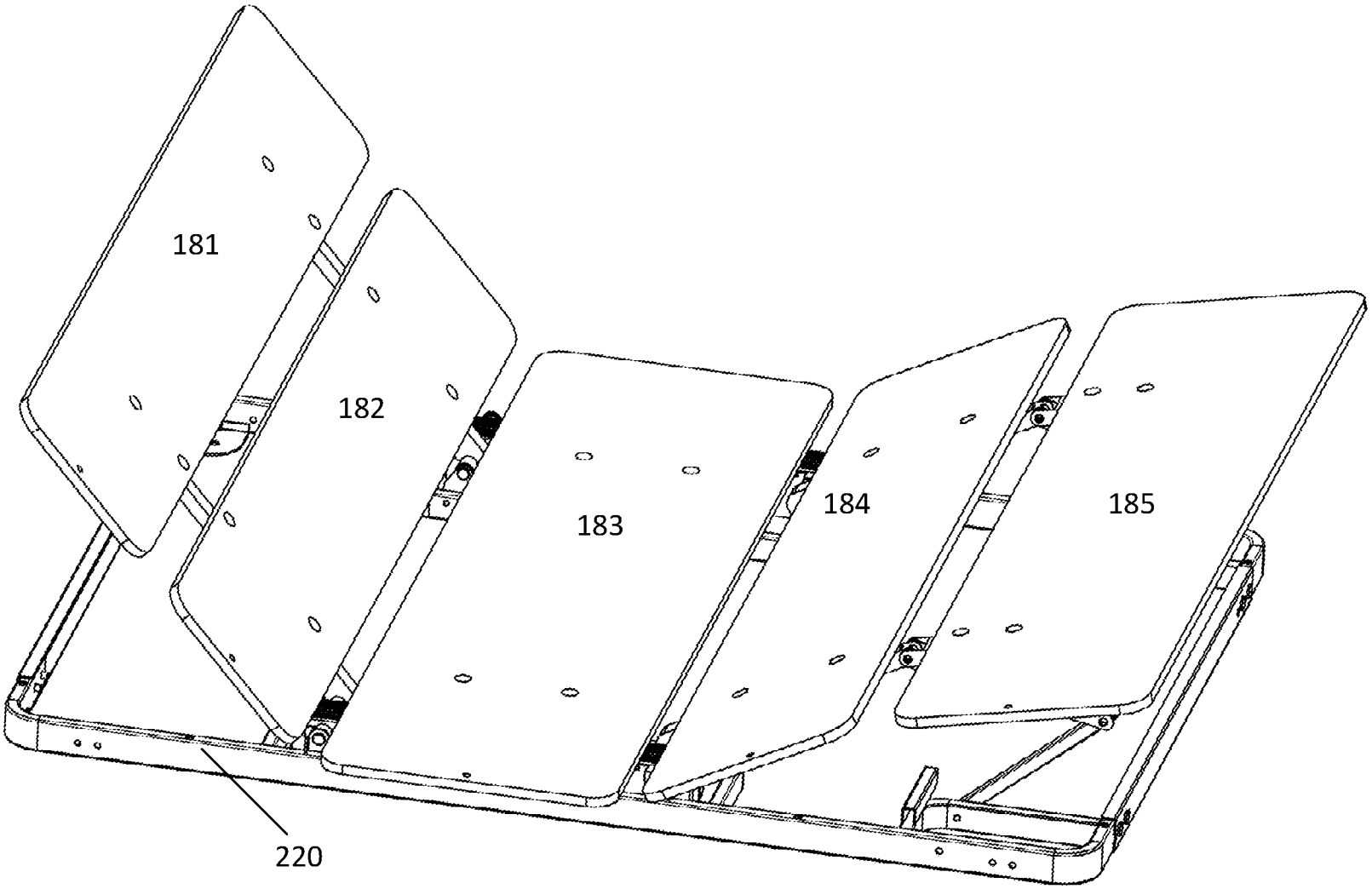
FIG. 15 shows schematically a front perspective view of the adjustable bed system in an adjusted state according to a second embodiment of the invention.

In one embodiment, each tab member comprises a single tab 114/115, or a plurality of tabs 214*a*, 214*b*, 214*c* and 214*d* (FIG. 12).

Figure 3:
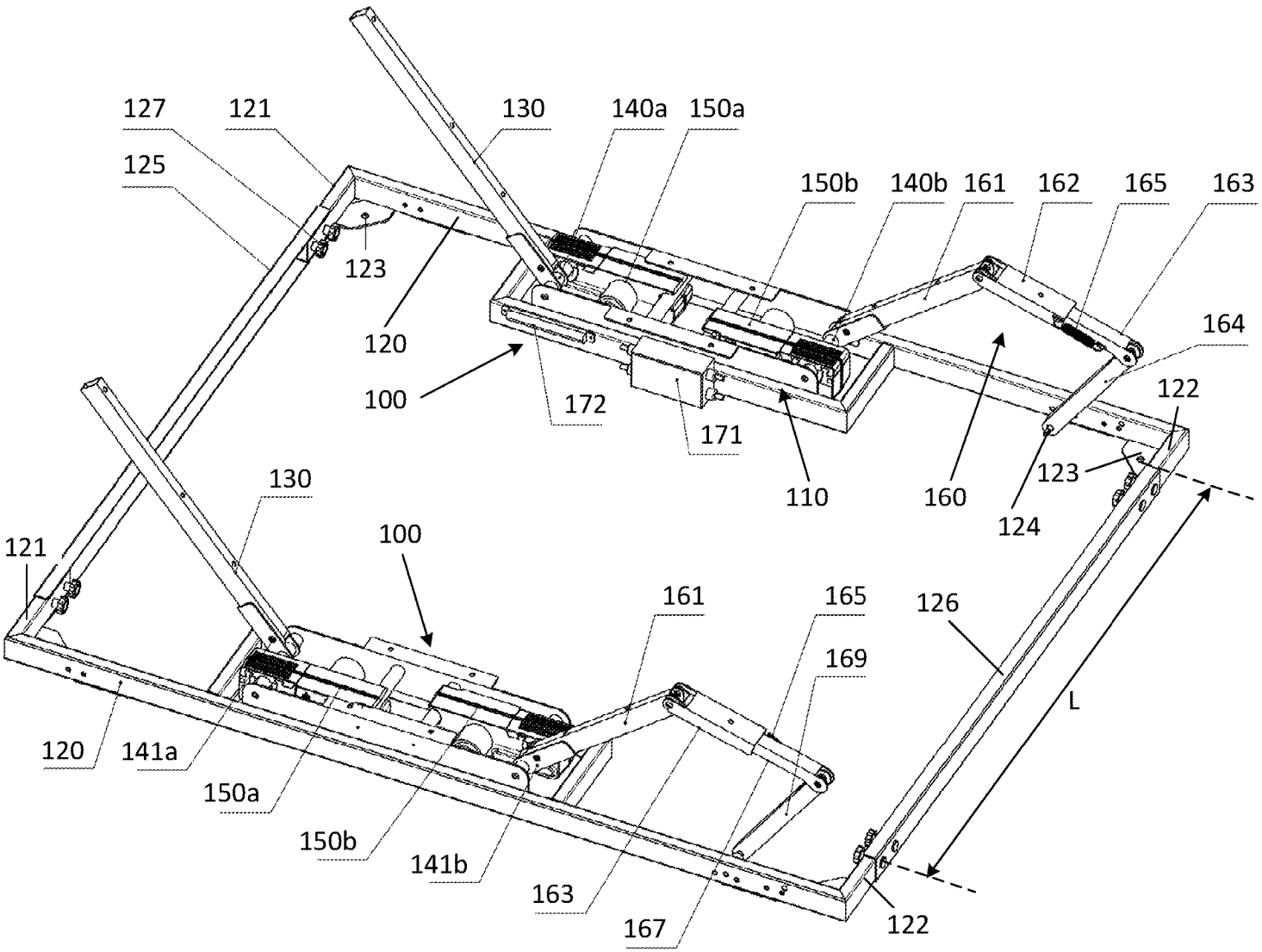
FIG. 3 shows schematically a front perspective view of the adjustable bed system shown in FIG. 1 in an adjusted state.
Figure 4:
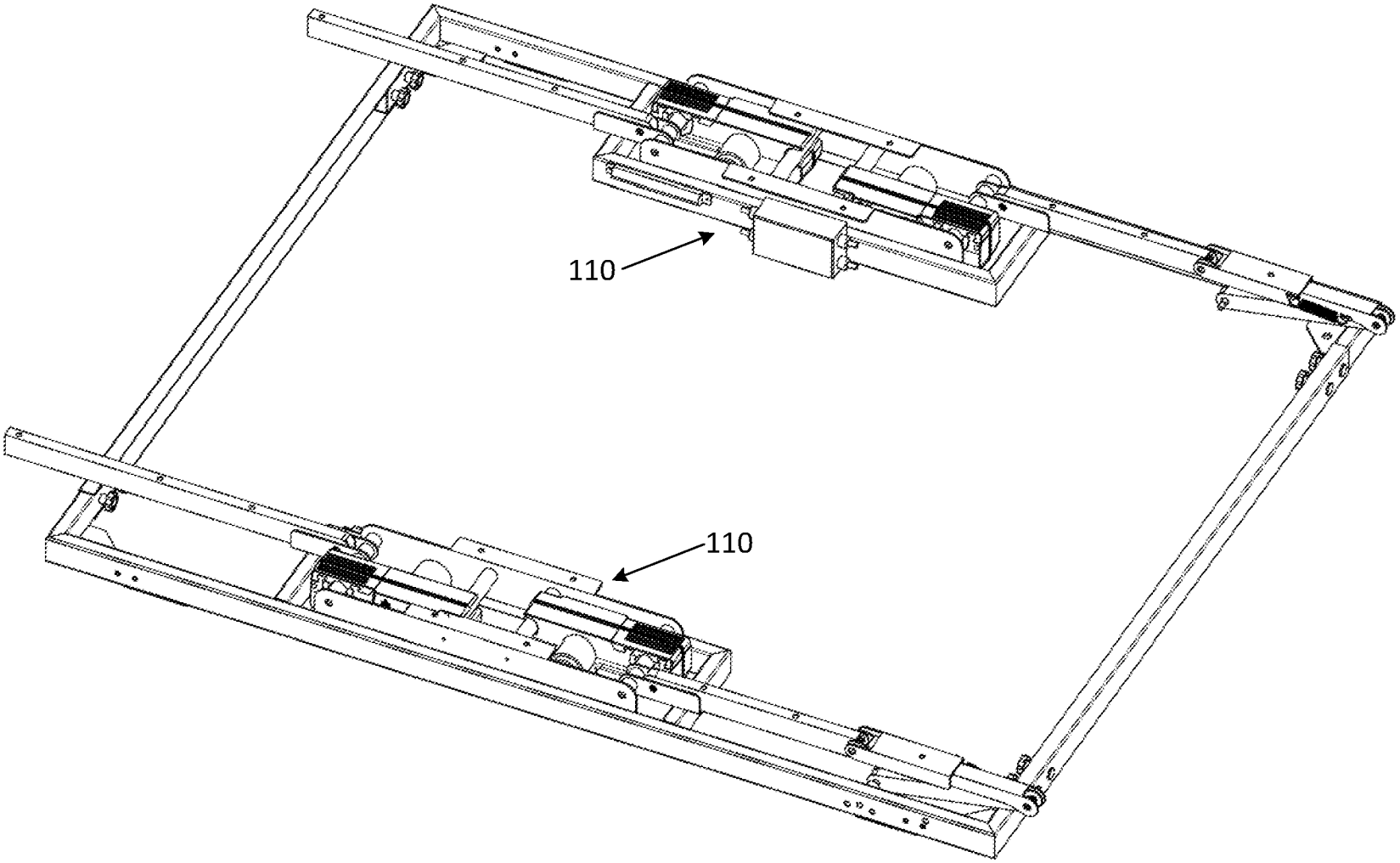
FIG. 4 shows schematically a front perspective view of the adjustable bed system shown in FIG. 1 in a plane state.
Figure 5:
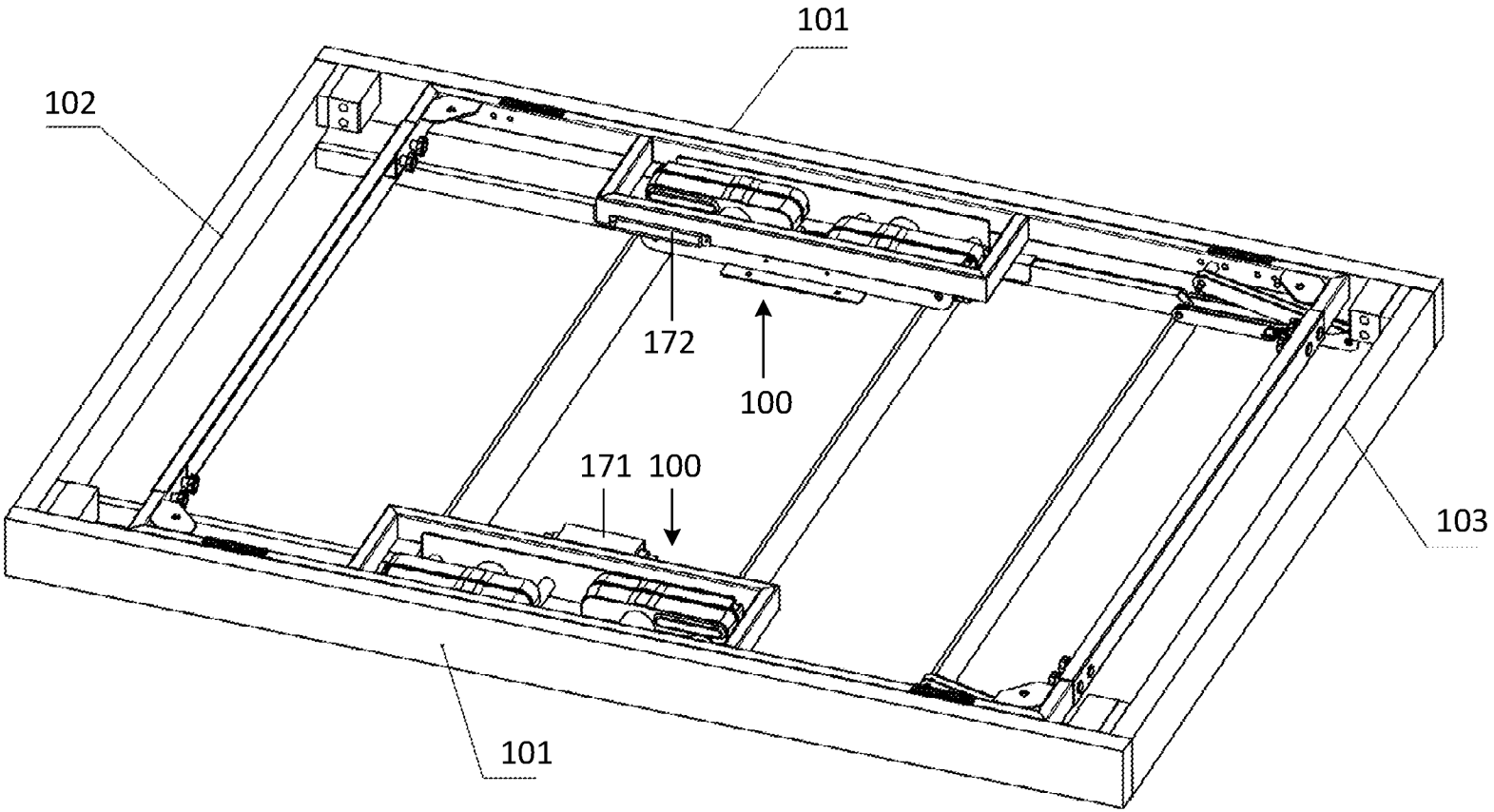
FIG. 5 shows schematically a back perspective view of the adjustable bed system shown in FIG. 1 in a plane state.

In one embodiment shown in FIGS. 2-3, the leg lifting mechanism 160 comprises first, second, third and fourth supporting members 161, 162, 163 and 164, where a first end 161*a* of the first supporting member 161 is connected to the first portion 144*b* of the driving shaft 140*b* of the leg lifting actuator, first ends 162*a* and 163*a* of the second and third supporting members 162 and 162 are connected to a second end 161*b* of the first supporting member 161 by a shoulder bolt or any other connection means, a first end 164*a* of the fourth supporting member 164 is connected to a second end 163*b* of the third supporting member 163 by a shoulder bolt or any other connection means, while the second end 164*b* of the fourth supporting member 164 is pivotally connected the side rails at the pivotal point 124 that is proximate to the end portion 122. These connections of the supporting members 161, 162, 163 and 164 are of pivotal connections. Further, the leg lifting mechanism 160 has an elastic member such as a spring 165 connected between the second end 162*b* of the second supporting member 162 and a position 163*c* proximate to the second end 163*b* of the third supporting member 163.

The adjustable bed system further includes a plurality of platforms 181-185 disposed on the pair of lifting assemblies 100 and coupled with the back lifting arm 130 and the leg lifting mechanism 160 such that positions of at least one or more of the plurality of platforms 181-185 are adjustable in accordance with operations of the back lifting arm 130 and the leg lifting mechanism 160.

Figure 11:
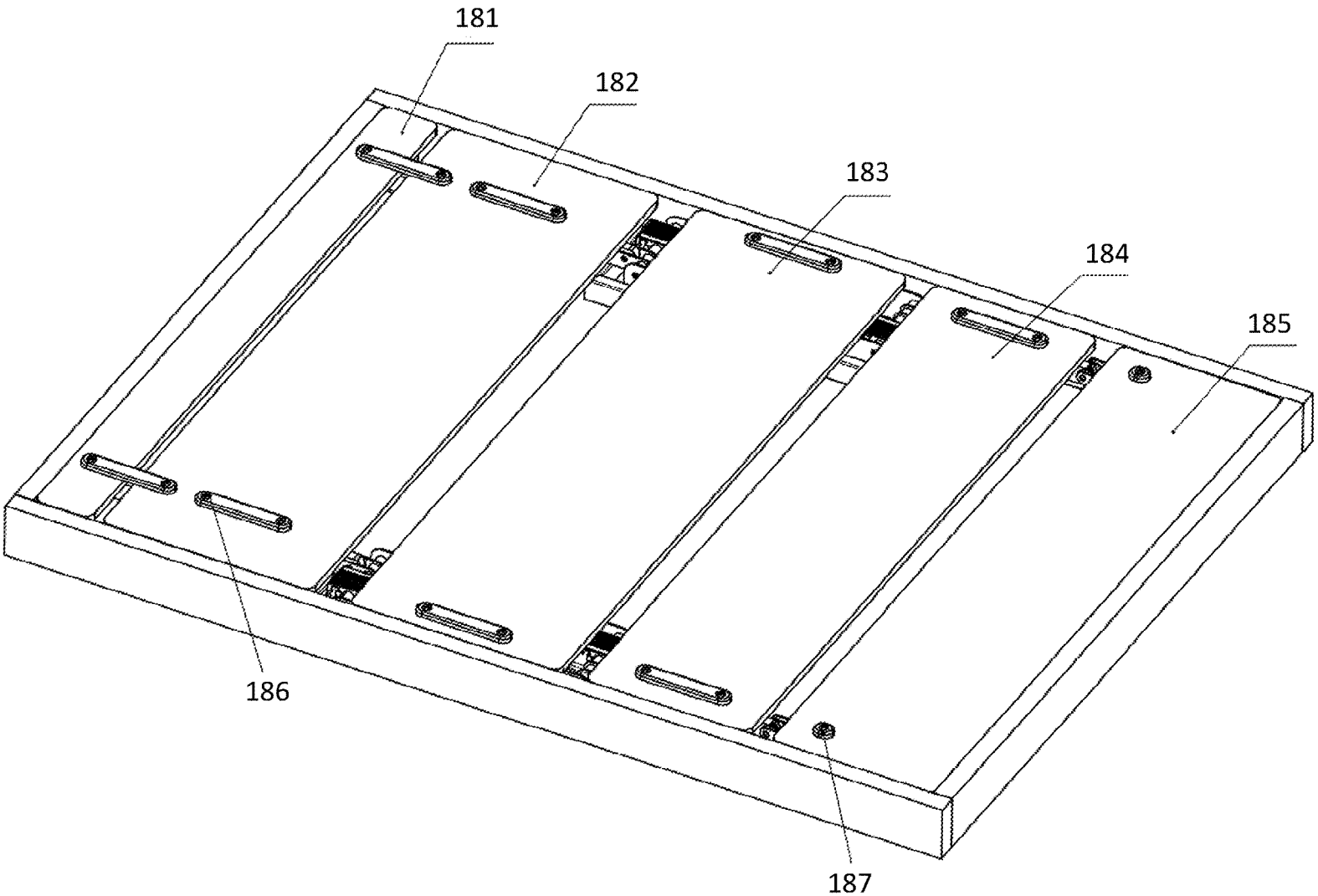
FIG. 11 shows schematically a front perspective view of the adjustable bed system shown in FIG. 1 in a plane state.

In one embodiment shown in FIG. 1, the plurality of platforms 181-185 comprises a seat platform 183 mounted on tops of the brackets 114 and 115 of the lifting assemblies 100; two back platform 181 and 182 coupled with the back lifting arm 130, such that the back platform 181 and 182 is operably rotatable around its lower edge in a back platform downward rotating direction or a back platform upward rotating direction; and a thigh platform 184 and a leg platform 185 coupled to the leg lifting mechanism 160, such that the thigh platform 184 is rotatable around its upper edge in a thigh platform downward rotating direction or a thigh platform upward rotating direction, and the leg platform is rotatable around its upper edge in a leg platform downward rotating direction or a leg platform upward rotating direction. In addition, a plurality of decoration member 186 and 187 may be attached to the plurality of platforms 181-185, as shown in FIGS. 1 and 11.

In addition, the adjustable bed system further includes a controller 171 configured to control operations of the back lifting actuator and the leg lifting actuator of each lifting assembly 100, so as to lift individually or cooperatively the back platforms 181 and 182, the thigh platform 184, and the leg platform 185 in desired positions. The adjustable bed system may also include one or more lighting members 172.

Figure 6:
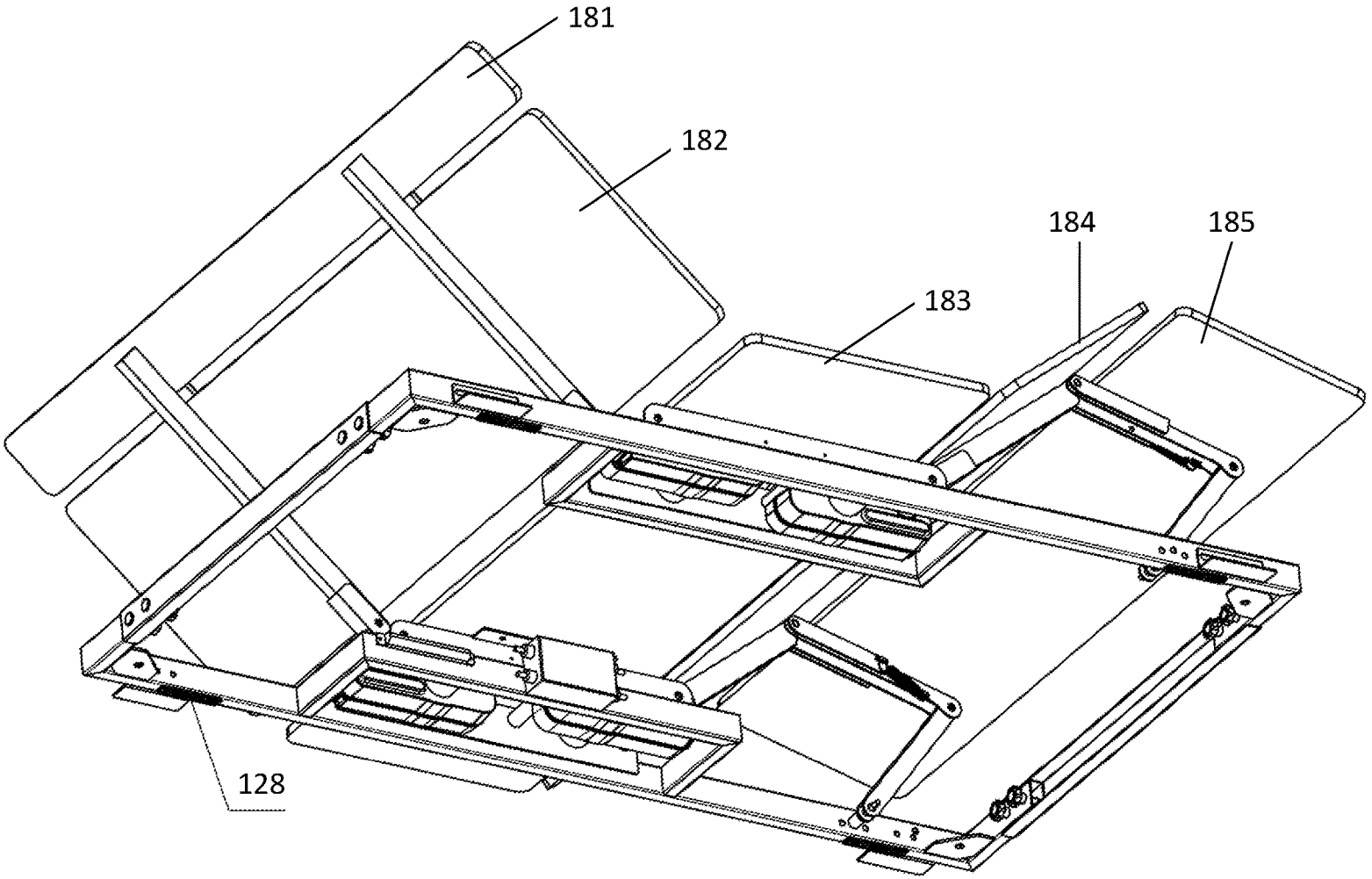
FIG. 6 shows schematically a back perspective view of the adjustable bed system shown in FIG. 1 in an adjusted state.
Figure 7:
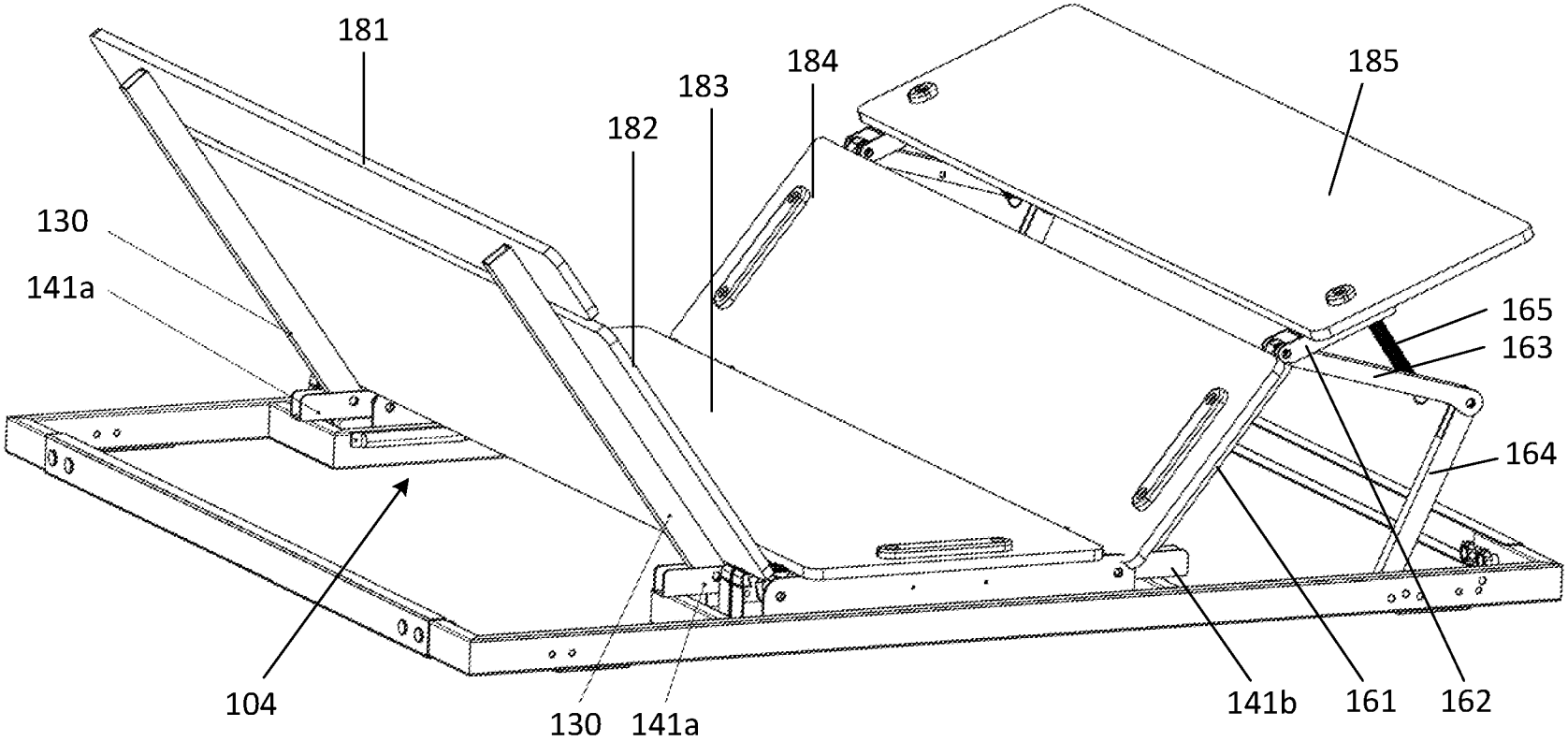
FIG. 7 shows schematically a front perspective view of the adjustable bed system shown in FIG. 1 in an adjusted state.

As assembled, the end portion 131 of the back lifting arm 130 is pivotally connected to the shoulder 141*a* of the driving shaft 143*a*, which is, in turn, received in the opening 153*a* of the motor member 150*a* and connected to the pair of tab member 114 and 115 through respective connecting holes 114*a* and 115*a*, while the motor member 151*a* is connected to the bar 117*a* through the groove 154*a*. In operation, the rotation of the motor 152*a* drives the driving shaft 143*a* to rotate accordingly. The rotation of the driving shaft 143*a* in turn drives the back lifting arm 130 to rotate around the end portion 131 so as to adjust the back lifting arm 130 at desired positions. In the upward rotation of the back lifting arm 130, the motor 151*a* drives the driving shaft 143*a* to rotate, thereby driving the back rotating arm 130 to move upward, as shown in FIGS. 2 and 6. In the downward rotation of the back lifting arm 130 (FIG. 7), because the back lifting arm 130 and the shoulder 141*a* of the driving shaft 143*a* are pivotally connected, they can move freely. If there is an obstacle below the back boards 181 and 182 in the space 104, the back platforms/boards 181 and 182 installed on the back lifting arm 130 will rest on the obstacle, and will not continue moving down, thereby preventing pinching from the downward rotation of the back lifting arm 130, as shown in FIG. 7.

Figure 8:
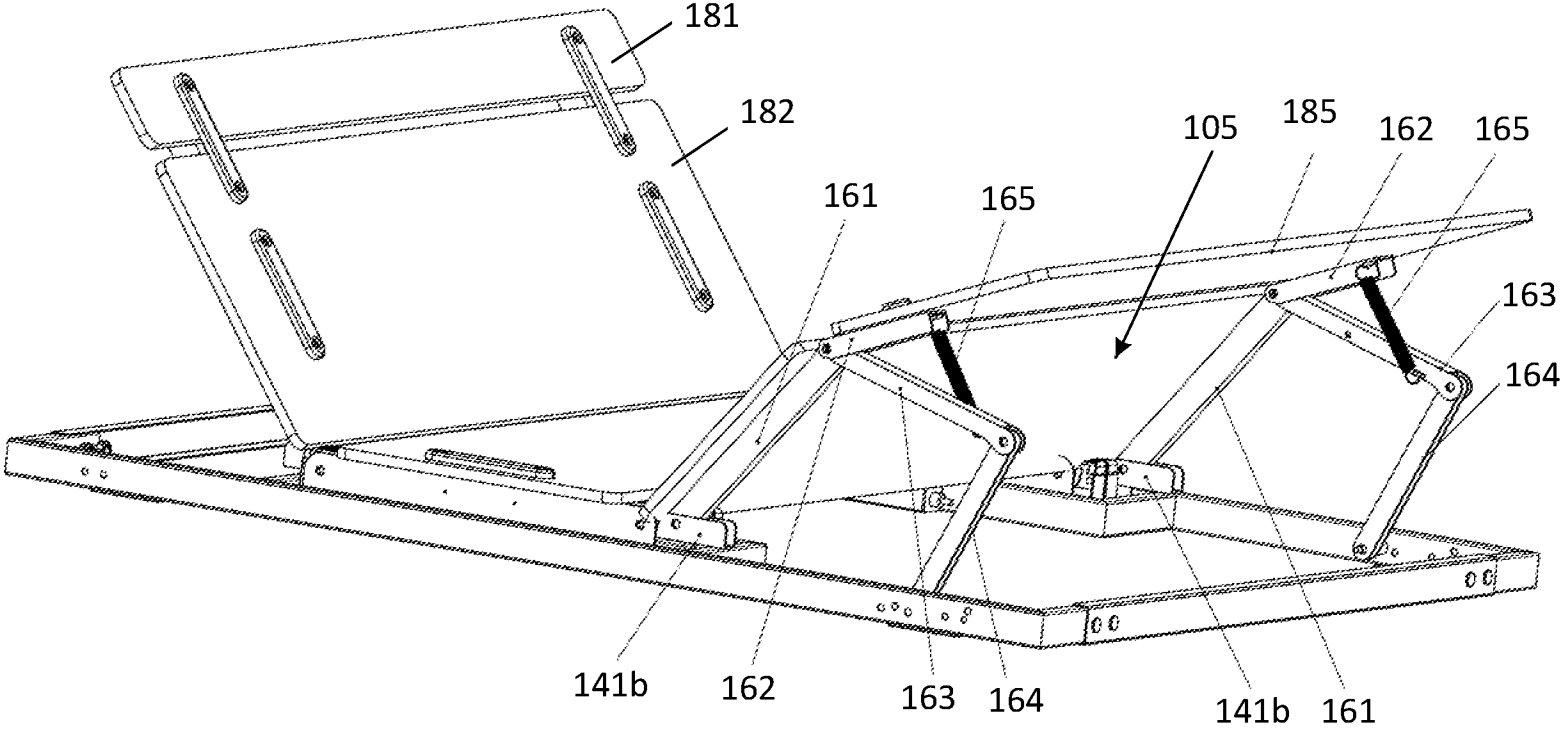
FIG. 8 shows schematically another front perspective view of the adjustable bed system shown in FIG. 1 in an adjusted state.
Figure 9:
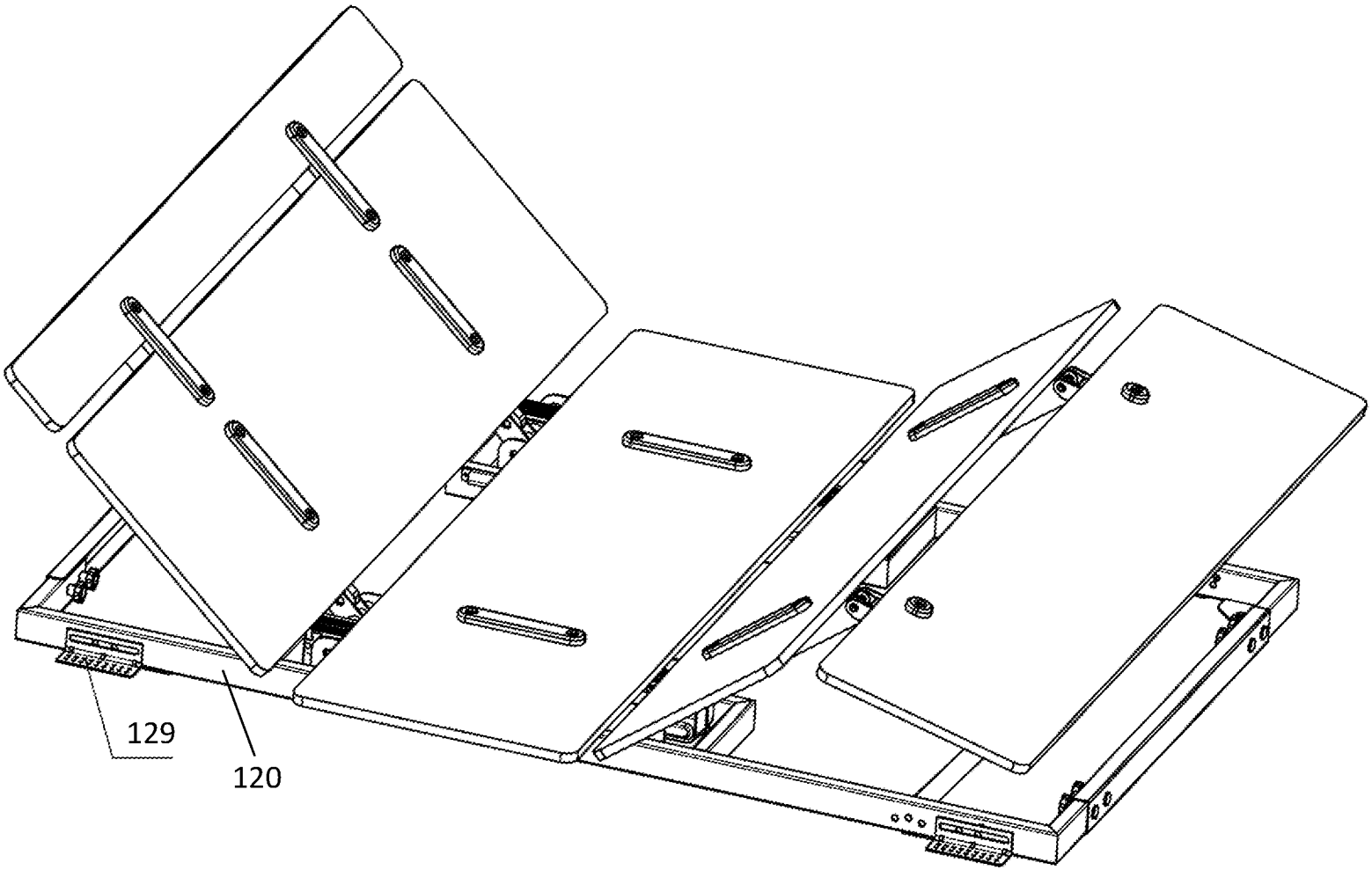
FIG. 9 shows schematically a front perspective view of the adjustable bed system shown in FIG. 1 in an adjusted state.
Figure 10:
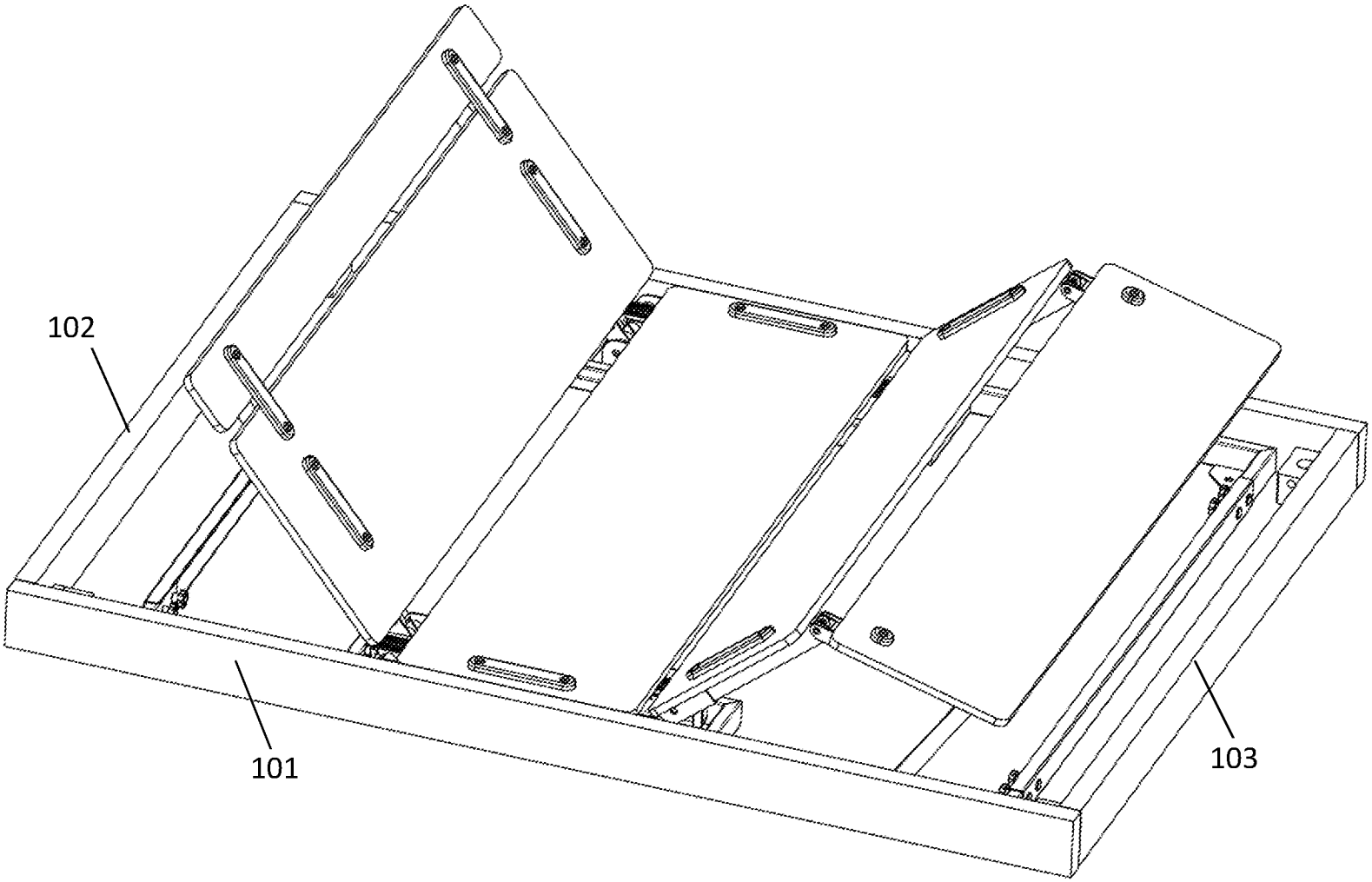
FIG. 10 shows schematically another front perspective view of the adjustable bed system shown in FIG. 1 in an adjusted state.

Similarly, as assembled, the first end portion 161*a* of the first supporting member 161 is pivotally connected to the shoulder 141*b* of the driving shaft 143*b*, which is, in turn, received in the opening 153*b* of the motor member 150*b* and connected to the pair of tab member 114 and 115 through respective connecting holes 114*b* and 115*b*, while the motor member 151*b* is connected to the bar 117*b* through the groove 154*b*. In operation, the rotation of the motor 152*b* drives the driving shaft 143*b* to rotate accordingly. The rotation of the driving shaft 143*b* in turn drives the first supporting member 161 to rotate around the first end portion 161*a* so as to adjust the leg lifting mechanism 160 at desired positions. In the upward rotation of the first supporting member 161, the motor 151*b* drives the driving shaft 143*b* to rotate, which drives the first supporting member 161 to move upward, thereby lifting the leg lifting mechanism 160 at a desired position, as shown in FIGS. 2 and 6. In the downward rotation of the first supporting member 161 (FIG. 8), because the first supporting member 161 and the driving shaft 143*a* are pivotally connected and the second and third supporting members 162 and 162 are connected to the first supporting member 161 by the shoulder bolt connection, when the leg falls down and encounters an obstacle in the space 105, the leg board/platform 185 will rotate with the second supporting member 162 due to the elasticity of the spring 165, thereby stretching the spring 165, as shown in FIG. 8. When the obstacle is removed, the spring 165 automatically contracts, thereby driving the leg board/platform 185 drops naturally.

FIGS. 12-15 show an adjustable bed system according to a second embodiment of the invention. The second embodiment of the adjustable bed system is essentially similar of the first embodiment of the bed system shown in FIGS. 1-11, except that each lifting assembly 200 has a bracket with each tab member including a plurality of tabs 214*a*/215*a*, 214*b*/215*b*, 214*c*/215*c* and 214*d*/215*d*, as shown in FIG. 12. In addition, the back lifting arm 230 is directly mounted to the driving shaft 243*a* of the activation member 240*a*. The first supporting member 261 is directly mounted to the driving shaft of the activation member 240*b*. One end portion 221 of the side rails 220 has a flange-type reinforcing member 223, the other end portion 222 of the side rail 220 has bar-type reinforcing member 270. In the embodiment, the second and third supporting members 262 and 263 are connected to the first supporting member 262, and the fourth supporting member 264 is pivotally connected between the third supporting member 263 and the reinforcing member 270 at the pivotal point 224. The back lifting arm 230 and the leg lifting mechanism 260 are driven by motor members 250*a* and 250*b* respectively.

The operations of the second embodiment of the bed system are essentially similar to that of the first embodiment of the bed system described above.

In sum, the invention provides an adjustable bed system that is capable of adjusting body positions based on user's sleep preference so that the user achieves maximum comfort during sleep, and can be easily assembled to improve assembly efficiency and increase the user's assembly experience. In addition, the size of the adjustable bed system can be changeable from one size to another size. Further, the adjustable bed system is designed to have anti-pinch functions. Another advantage of this invention is that the drive system (i.e., the lifting assemblies) and the boards/platforms are separated and thus can be packed in two cartons separately, which may reduce the inventory pressure on dealers. One can buy a large number of the drive systems, then buy different sizes of boards/platforms, and assemble them accordingly.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed system, comprising:

a pair of side rails transversely spaced, longitudinally aligned and arranged parallel to each other; and a pair of lifting assemblies attached respectively to the pair of side rails for operably adjusting positions of at least one part of a bed, wherein each lifting assembly comprises:

a back lifting arm and a leg lifting mechanism;

a bracket; and a back lifting actuator and a leg lifting actuator received in the bracket, wherein each of the back and leg lifting actuators comprises an activation member and a motor member engaged with the activation member for driving the activation member, wherein the activation member of the back lifting actuator is engaged with the back lifting arm for operably adjusting the back lifting arm at desired back positions, and the activation member of the leg lifting actuator is engaged to the leg lifting mechanism for operably adjusting the leg lifting mechanism at desired leg positions, wherein the activation member comprises a driving shaft having a first portion and a second portion extending from the first portion, the second portion being engaged with the motor member, wherein the activation member of the back lifting actuator is engaged with the back lifting arm through engaging the first portion of the driving shaft with one end portion of the back lifting arm, and wherein the activation member of the leg lifting actuator is engaged with the leg lifting mechanism through engaging the first portion of the driving shaft with one end portion of the leg lifting mechanism;

wherein the motor member comprises a body having an opening formed at one end portion and a motor mounted on the body, wherein the opening is configured for receiving the second portion of the driving shaft of the activation member so as to engage the motor member with the activation member; and wherein the bracket comprises a base member attached to a respective one of the pair of side rails, a pair of tab members vertically attached to the base member, and a pair of bars transversely attached to top portions of the pair of tab members.

2. The adjustable bed system of claim 1, wherein the driving shaft further has at least one claw protruded from the second portion such that the second portion is engaged with the motor member through the at least one claw.

3. The adjustable bed system of claim 1, wherein the activation member further comprises a shoulder mounted on the first portion of the driving shaft for engaging the first portion of the driving shaft with said one end portion of the back lifting arm or the leg lifting mechanism.

4. The adjustable bed system of claim 1, wherein one of the pair of tab members is attached to the base member and the other of the pair of tab members is attached to the respective side rail such that the pair of tab members is transversely spaced, longitudinally aligned and parallel to each other, and wherein the pair of bars is longitudinally spaced and transversely aligned and parallel to each other, wherein each tab member has two connecting holes defined at two end portions of said tab member, and the pair of bars is positioned between the connecting holes of the pair of tab members.

5. The adjustable bed system of claim 1, wherein each tab member comprises a single tab or a plurality of tabs.

6. The adjustable bed system of claim 4, wherein as assembled, the driving shaft of the activation member is rotatably connected to the pair of tab member through respective connecting holes and a groove formed in another end portion of the body of the motor member receives a respective one of the pair of bars, so that the back lifting actuator and the leg lifting actuator securely attached to the bracket.

7. The adjustable bed system of claim 4, wherein the leg lifting mechanism comprises first, second, third and fourth supporting members, wherein a first end of the first supporting member is connected to the first portion of the driving shaft of the leg lifting actuator, first ends of the second and third supporting members are connected to a second end of the first supporting member, a first end of the fourth supporting member is connected to a second end of the third supporting member.

8. The adjustable bed system of claim 7, wherein the leg lifting mechanism further comprises an elastic member connected between the second end of the second supporting member and a position of the third supporting member.

9. The adjustable bed system of claim 7, further comprising a plurality of platforms disposed on the pair of lifting assemblies and coupled with the back lifting arm and the leg lifting mechanism such that positions of at least one or more of the plurality of platforms are adjustable in accordance with operations of the back lifting arm and the leg lifting mechanism.

10. The adjustable bed system of claim 9, wherein the plurality of platforms comprises:

a seat platform mounted on tops of the brackets of the lifting assemblies;

at least one back platform coupled with the back lifting arm, such that the at least one back platform is operably rotatable around its lower edge in a back platform downward rotating direction or a back platform upward rotating direction; and a thigh platform and a leg platform coupled to the leg lifting mechanism, such that the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

11. The adjustable bed system of claim 1, further comprising a controller configured to control operations of the back lifting actuator and the leg lifting actuator of each lifting assembly, so as to lift individually or cooperatively the back lifting arm and the leg lifting mechanism at desired leg positions.

12. The adjustable bed system of claim 1, further comprising an upper rail and a lower rail being longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, wherein each of the upper rail and the lower rail has a length L that is adjustable or fixed and defines a size of the bed.

13. An adjustable bed system, comprising:

a pair of side rails transversely spaced, longitudinally aligned and arranged parallel to each other; and a pair of lifting assemblies attached respectively to the pair of side rails for operably adjusting positions of at least one part of a bed, wherein each lifting assembly comprises:

a back lifting arm and a leg lifting mechanism;

a bracket, wherein the bracket comprises a base member attached to a respective one of the pair of side rails, a pair of tab members vertically attached to the base member, and a pair of bars transversely attached to top portions of the pair of tab members; and a back lifting actuator and a leg lifting actuator received in the bracket, wherein each of the back and leg lifting actuators comprises an activation member and a motor member engaged with the activation member for driving the activation member, wherein the activation member of the back lifting actuator is engaged with the back lifting arm for operably adjusting the back lifting arm at desired back positions, and the activation member of the leg lifting actuator is engaged to the leg lifting mechanism for operably adjusting the leg lifting mechanism at desired leg positions.

* * * * *